US007201371B2

(12) United States Patent
Lu

(10) Patent No.: US 7,201,371 B2
(45) Date of Patent: Apr. 10, 2007

(54) AUTOMATIC PAPER-FEEDING STRUCTURE

(75) Inventor: Wen-Jen Lu, Taipei (TW)

(73) Assignee: BENQ Corporation, TaoYuan (TW)

( * ) Notice: Subject to any disclaimer, the term of this patent is extended or adjusted under 35 U.S.C. 154(b) by 334 days.

(21) Appl. No.: 10/855,743

(22) Filed: May 28, 2004

(65) Prior Publication Data

US 2004/0251594 A1 Dec. 16, 2004

(30) Foreign Application Priority Data

May 30, 2003 (TW) ..... 92209945 U

(51) Int. Cl.
*B65H 9/04* (2006.01)

(52) U.S. Cl. ..... 271/253; 271/246; 271/254

(58) Field of Classification Search ..... 271/246, 271/245, 253, 254, 121, 226, 126
See application file for complete search history.

(56) References Cited

U.S. PATENT DOCUMENTS 5,171,006 A * 12/1992 Naito ..... 271/9.09
6,491,295 B2 * 12/2002 Otsuka et al. ..... 271/118
6,598,873 B2 * 7/2003 Takisawa et al. ..... 271/246

* cited by examiner

*Primary Examiner*—Patrick Mackey
*Assistant Examiner*—Kaitlin Joerger
(74) *Attorney, Agent, or Firm*—Troxell Law Office, PLLC

(57) ABSTRACT

The invention is an automatic paper-feeding structure, which includes: a lifting member, which is arranged at the paper-feeding side of this automatic paper-feeding structure, and on which plural document papers are supported, and which may make the plural document papers skewed to one side and lifted up; a paper-taking member, of which face generates frictional force to the first paper of the document to make the first paper touched by the member's face be fed into the interior of the paper-feeding structure by the paper-taking member; a paper-separating member, which is with the paper-taking member to generate the squeezing function onto the papers and is able to separate the paper, such that the first paper on the document may be separated from other papers thereunder; a paper-feeding member, which receives the papers delivered from the paper-taking member and generates necessary interaction with the paper-separating member and the de-skewing member; a de-skewing member, which makes a de-skewing and delivering job upon the first paper transferred by the paper-feeding member and prevents other document papers from entering the interior of the paper-feeding member; a sensor, which is arranged at another side of the de-skewing member corresponding to the paper to detect if the paper has already entered the de-skewing member; a scan member, which receives the papers delivered by the paper-feeding member and processes a scanning and printing job upon the papers.

13 Claims, 5 Drawing Sheets

AUTOMATIC PAPER-FEEDING STRUCTURE

FIELD OF THE INVENTION

The invention relates to an automatic paper-feeding structure, and in particular, to a de-skewing structure cooperating with the paper-feeding structure in a scanner, such that it may ensure that the document except for first paper will not be carried into the interior of the paper-feeding structure and a structure of high stability and clear paper separation will be achieved.

BACKGROUND OF THE INVENTION

Accordingly, for a modern automatic office, the usage of business machine is quite frequent, such as: photocopy machine, facsimile machine, and printer, etc., all which must be arranged automatic paper-feeding system to fulfill quick feed of paper required by these machines, such that the entire processing speed of aforementioned machines may further be speeded up but, when a lot of document is taken care during current image scanning process, it is impossible to simplify the scanning action and it wastes a lot of time, so a preferable automatic paper-feeding structure is needed to achieve the objective of saving time and labor.

For most traditional automatic paper-feeding system, simple rubber rollers cooperating with one to two frictional pads are applied to deliver and separate papers. Please refer to FIG. 1. When the papers in the document box are going to make a flattening motion, a pair of pickup rollers 11, a first paper-separating pad 12, and a second paper-separating pad 13 will be applied, and the all documents are stacked up upon a paper plate 14 arranged under the pickup roller 11. In the meantime, a reverse rotation is generated in the opposite direction of paper feeding, such that the upper first paper is arced up at the pickup rollers 11 to make the front end of the first paper 151 generate flattening function. Afterwards, the pickup rollers 11 carry the first paper 151 into the interior of machine by a normal force. When this structure uses pickup rollers 11 to push the first paper 151 backwards in reverse direction, it may find that the front end of first paper 151 can't accurately be located between two pickup rollers 11, so all sorts of problem—impossible to pick up papers and flatten the papers inaccurately—may be occurred when the pickup rollers 11 make forward rotation.

According to the real operation experience in applying this structure, it may find that the structure disclosed by the prior arts frequently can't pick up paper in accurate way or the paper is not fed symmetrically, that is, a skewing situation of feeding paper occurs when the paper is picked up, even happened a multi-feeding phenomenon. Two or three aforementioned situations will further cause paper-jammed harassment on these kinds of paper-feeding structure. So, how to create an innovative structure to solve the poor design of paper-feeding structure seen in the prior arts is seriously regarded as an important issue to us.

SUMMARY OF THE INVENTION

Based upon the objective to solve the shortcomings mentioned in above prior arts, the invention is to propose an automatic paper-feeding structure. The main objective of the invention is to provide a sensor cooperating with the de-skewing structure in an automatic paper-feeding structure, such that it may ensure that the document except for first paper will not be carried into the interior of the paper-feeding structure and a structure of high stability and clear paper separation will be achieved.

To reach aforementioned objective, an automatic paper-feeding structure according to the invention includes following components:

a lifting member, disposed at one paper-feeding side of the automatic paper-feeding structure, for supporting a plural of media and lifting up the media;

a paper-taking member, for carrying the first medium of the media into the interior of the automatic paper-feeding structure;

a paper-separating member, for cooperating with the paper-taking member to squeeze medium and separate medium from each other, such that the first medium on the media is separated from other stacked media thereunder;

a paper-feeding member, for receiving the media transferred from the paper-taking member;

a de-skewing member, for de-skewing and transporting the first medium transferred from the paper-feeding member, and preventing other media from entering into the interior of the automatic paper-feeding structure, wherein after the de-skewing member is interacted with the paper-separating member, the medium will be sent out; and a sensor, disposed at another side of the de-skewing member opposite to the media to sense if the medium has already entered the de-skewing member;

a scan member, which receives the papers delivered by the paper-feeding roller and processes a scanning and printing job upon the papers.

For your esteemed members of reviewing committee to further understand and recognize the invention, a detailed description together with corresponding drawings are presented as follows.

DETAILED DESCRIPTION OF THE INVENTION

For facilitating your esteemed member of reviewing committee in understanding the invention, a detailed structure cooperating with following drawings together with its connective relationship is presented as follows.

Figure 2:
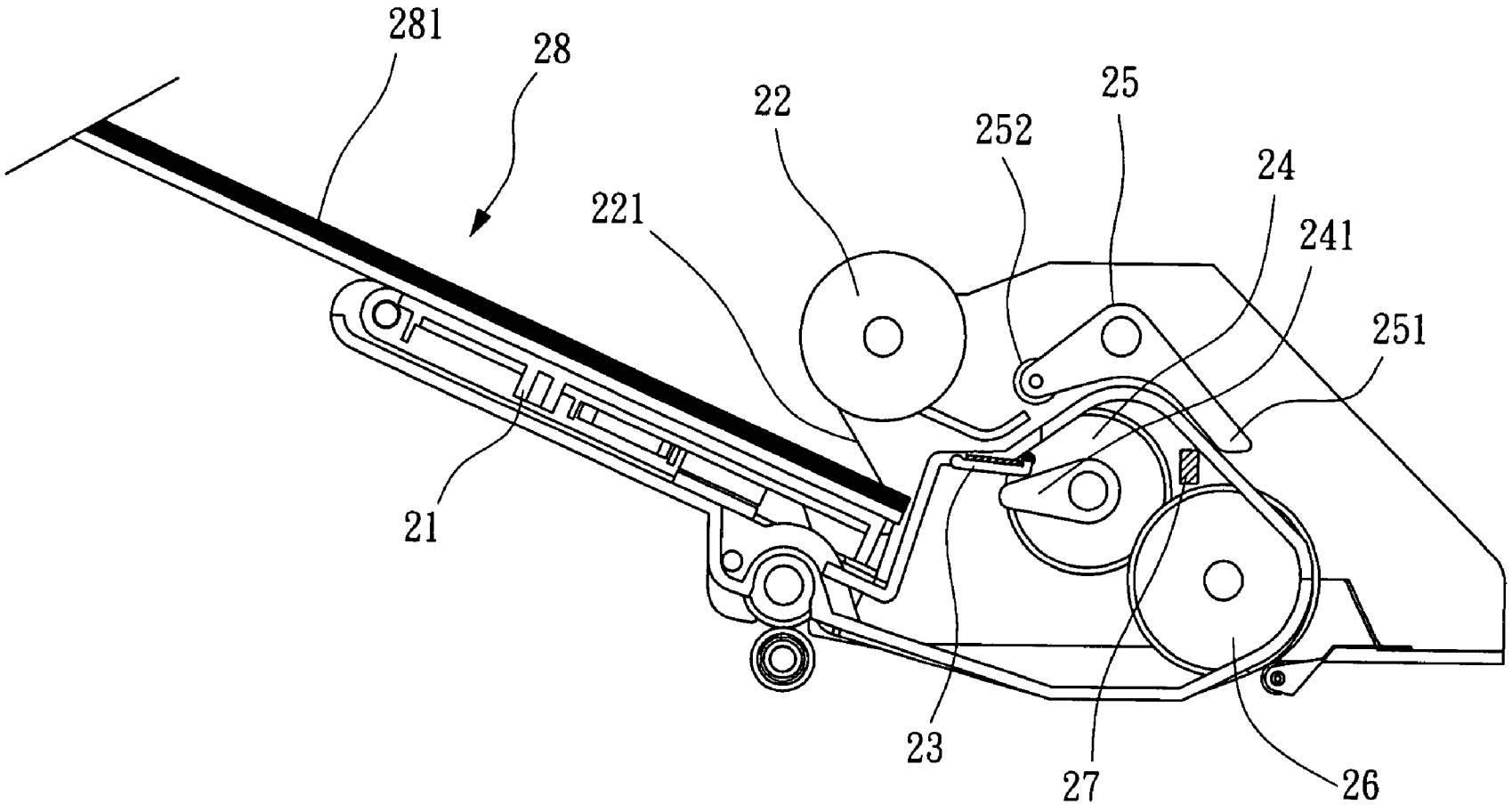
FIG. 2 is the first preferable embodiment for the automatic paper-feeding structure according to the invention.
Figure 3:
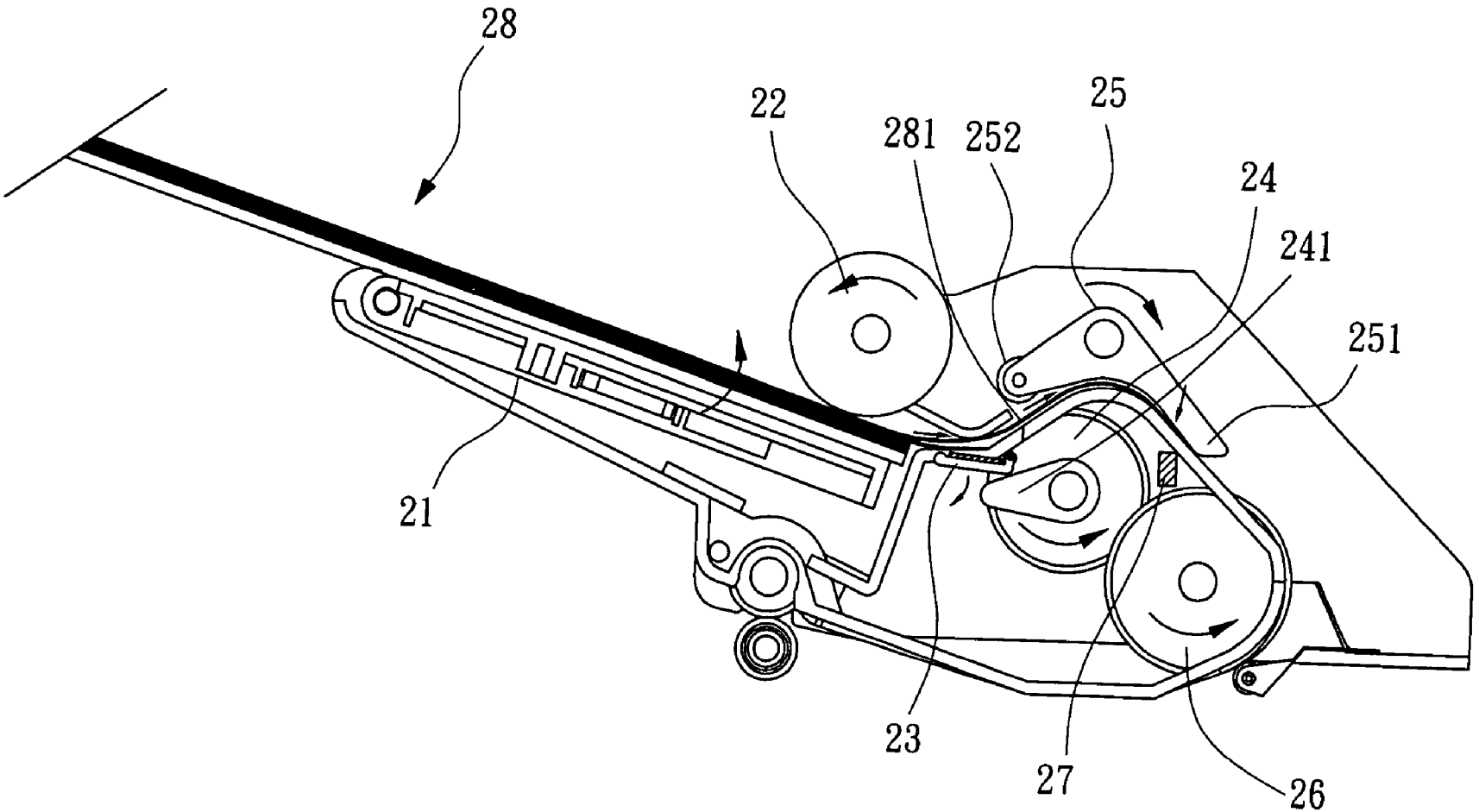
FIG. 3 is the second preferable embodiment for the automatic paper-feeding structure according to the invention.
Figure 4:
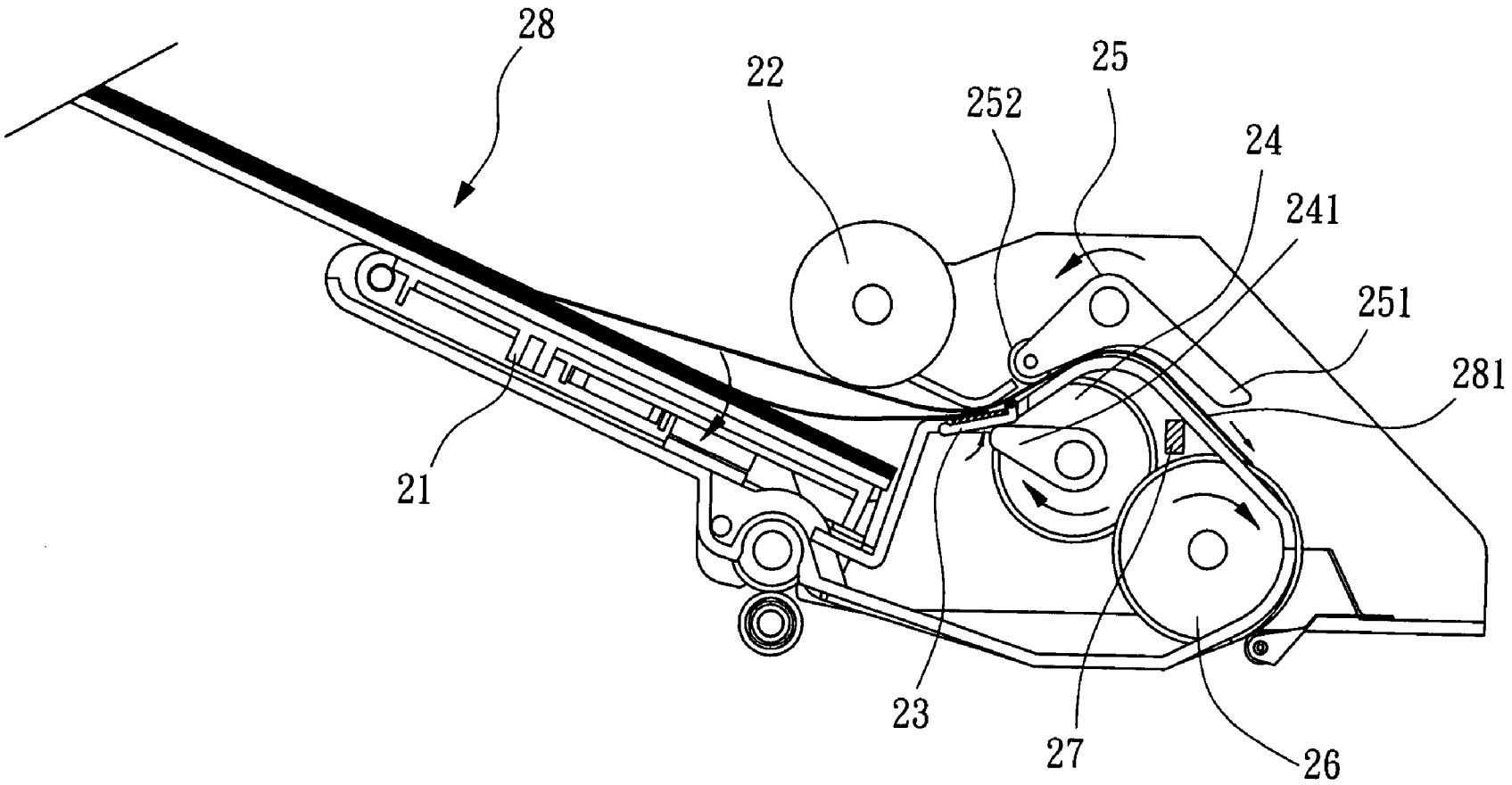
FIG. 4 is the third preferable embodiment for the automatic paper-feeding structure according to the invention.
Figure 5:
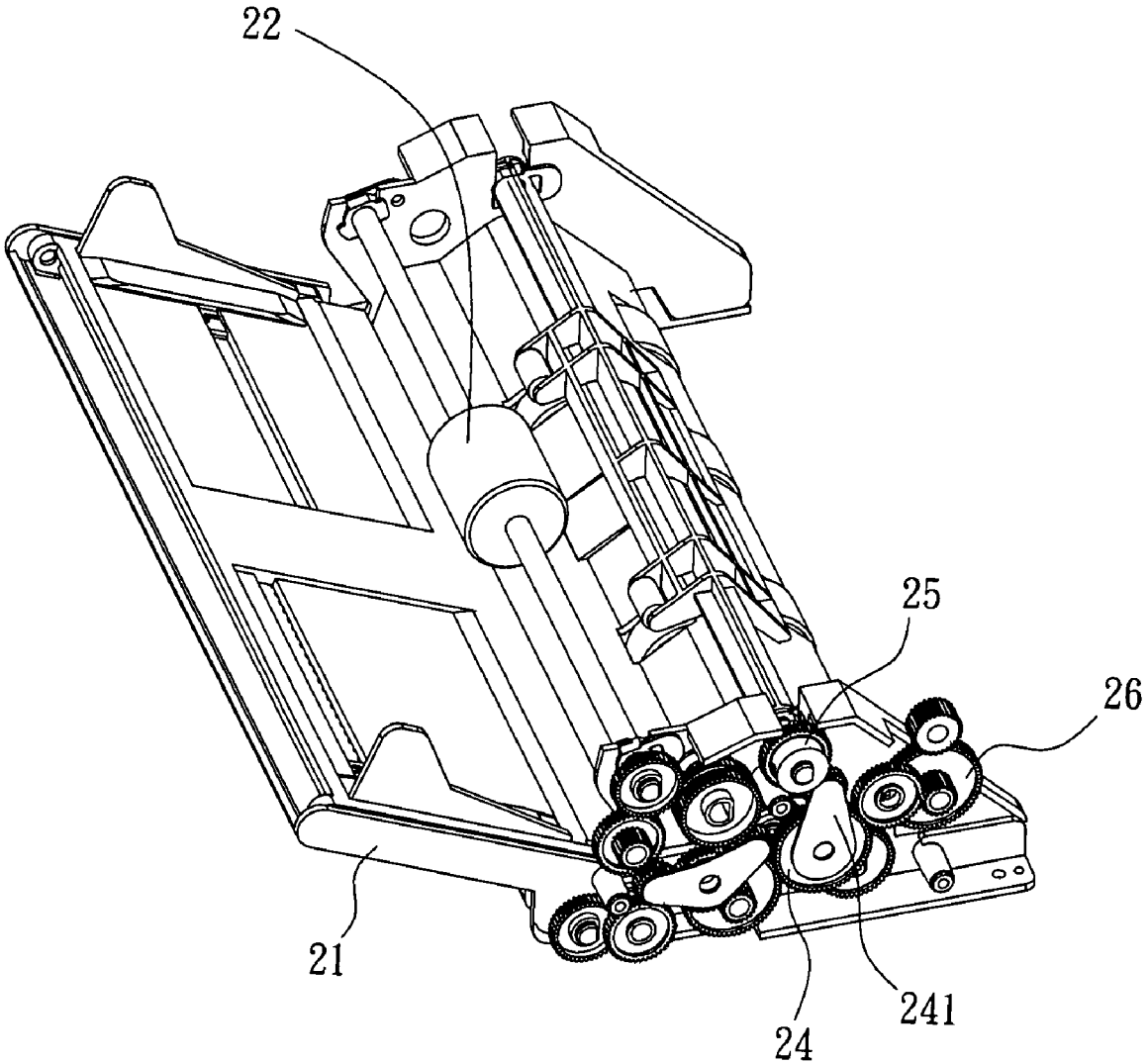
FIG. 5 is a 3-D outer structure view for the automatic paper-feeding structure according to the invention.

Please refer to FIG. 2, which is the first preferable embodiment for the automatic paper-feeding structure according to the invention, wherein it is obvious that the invention includes following components:

a lifting member 21, which is arranged at the paper-feeding side of this automatic paper-feeding structure, and on which plural document papers 28 are supported, and which may make the plural document papers 28 skewed to one side and lifted up; a paper-taking member 22, of which face generates frictional force to the first paper 281 of the document 28 to make the first paper 281 touched by the member's face be fed into the interior of the paper-feeding structure by the paper-taking member 22; a paper-separating member 23, which is with the paper-taking member 22 to generate the squeezing function onto the papers 28 and is able to separate the paper 28, such that the first paper 281 on the document 28 may be separated from other papers thereunder; a paper-feeding member 24, which receives the papers 28 delivered from the paper-taking member 22 and generates necessary interaction with the paper-separating member 23 and the de-skewing member 25; a de-skewing member 25, which makes a de-skewing and delivering job upon the first paper 281 transferred by the paper-feeding member and prevents other document papers 28 from entering the interior of the paper-feeding member 25; a sensor 27, which is arranged at another side of the de-skewing member 25 corresponding to the paper to detect if the paper has already entered the de-skewing mechanism 25; a scan member 26, which receives the papers delivered by the paper-feeding member 24 and processes a scanning and printing job upon the papers 28.

(1) When paper is being fed, the lifting member 21 faces upwards, and the paper-taking member 22 is rotated in counterclockwise direction to carry the all documents 28 into the paper-separating member 23 to make a paper-separating motion, such that the first paper 281 on the all documents 28 is separated from other papers stacked thereunder, and a paper guide 221 further restrains the other documents 28 within the operational range of the paper-separating member 23.

(2) After the paper-separating member 23 made the paper-separating motion, the first paper 281 will enter into a de-skewing member 25 to de-skew the left side and right side of the paper, and a sensor 27 is arranged at the de-skewing member 25 to detect whether the first paper 281 enters the de-skewing member 25 or not, and the sensor 27 may be a general sensor of electronic type or mechanical type to detect the moving state of the first paper 281 and, when the paper face of the first paper 281 is arced up at the first end 251 of the de-skewing member 25 and the arced-up paper face is abutted to the lower portion of the first end 251 along the curving face of the first end 251, a motor (not shown in the drawings) makes a motion of reverse rotation to bring along the second end 252 of the de-skewing member 25 to press down the first paper 281, and the first end 251 is lifted upwards, then it is possible to make the first paper 281 enter the scan member 26 zone from the paper-feeding member 24 and, in the meantime, the paper-separating member 23 is lifted up by a cam 241 to prevent other documents from entering the paper-feeding member 24.

Figure 1:
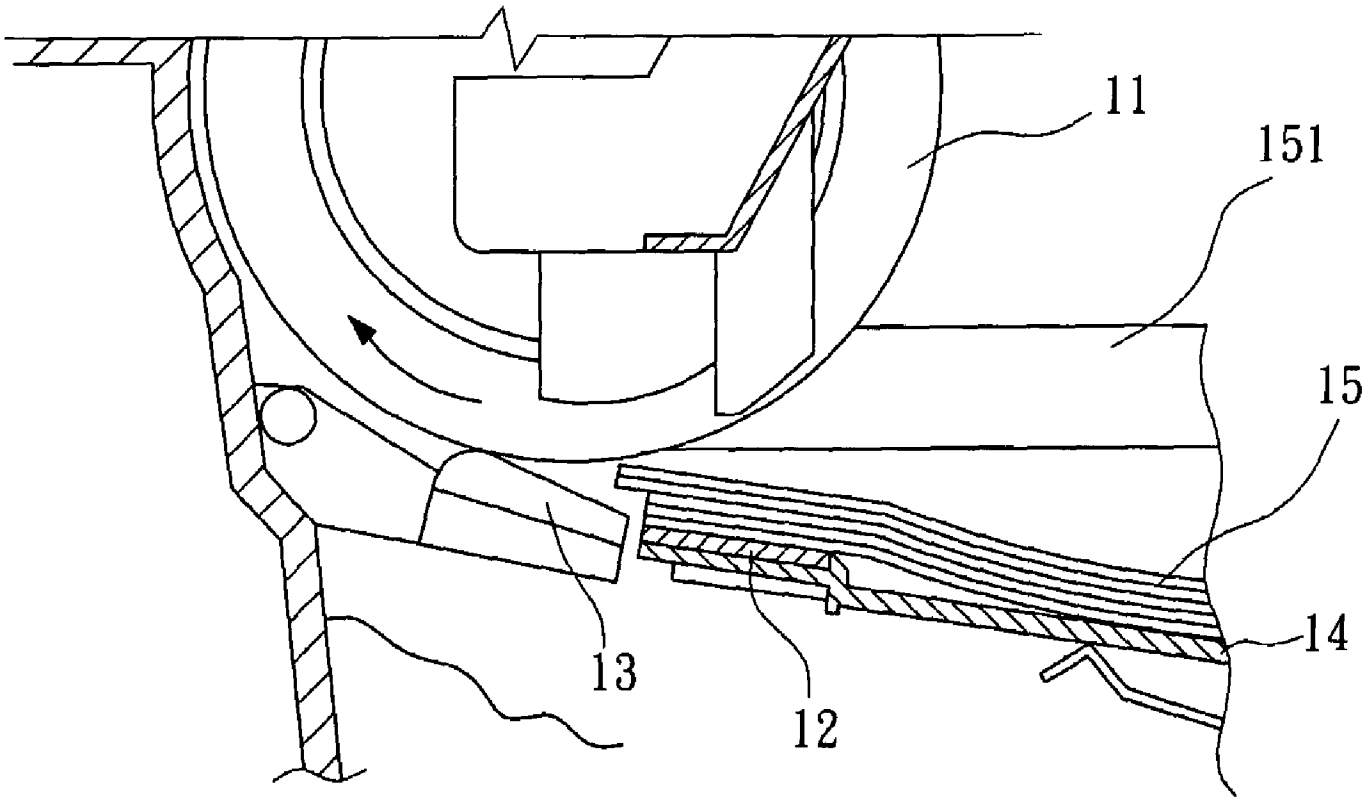
FIG. 1 (PRIOR ART)
FIG. 1 is a cross-sectional side view for the automatic paper-feeding structure according to prior art.

From the description disclosed from FIG. 2 to FIG. 5, it may understand how the invention improves the paper-separating mechanism according to the prior arts (as shown in FIG. 1): when its first paper-separating pad 12 and second paper-separating pad 13 are contacted adjacently with the pickup roller 11, the pickup roller 11 barely grasps the edge of uppermost paper because of limited space and, it will cause different grasping angles for each piece of paper because the thickness of documents stacked in the paper box will be decreased following the papers being fed, so it will happen that the paper-feeding structure can't pick up the paper accurately; the invention is to overcome this problem, that is, the paper-separating member 23 is lifted upwards to make each picking-up angle of the paper-taking member 22 maintain a constant altitude and, furthermore, an elastic guide is applied to provide a normal force to the paper-separating member 23, such that the paper-separating member 23 may generate a more accurate function of paper separation. In the meantime, the invention makes a structural separation between the de-skewing member 25 and the paper-feeding member 24, such that the failure to pickup paper after the front end of the fed paper being de-skewed in the prior arts will be solved, so the function of the automatic paper-feeding structure according to the invention is achieved.

In summary, the structural characteristics of the invention and each preferable embodiment have already been disclosed in detail. The automatic paper-feeding structure according to the invention may be applied to many electronic devices, such as: printer, photocopy machine, facsimile machine, scanner, and other multi-functional peripheral (abbreviated as MFP). The invention may indeed achieve the function of accurate paper separation to sufficiently show that the invention deeply has the executable progressiveness in both objective and function and extremely has the applying value for industry, besides the invention being an application that has never been seen in current market so, according to the spirits described in patent law, the invention is completely fulfilled the merits of an innovative invention.

What is claimed is:

1. An automatic paper-feeding structure, which comprises:

a lifting member, disposed at one paper-feeding side of the automatic paper-feeding structure, for supporting a plural of media and lifting up the media;

a paper-taking member, for carrying the first medium of the media into the interior of the automatic paper-feeding structure;

a paper-separating member, for cooperating with the paper-taking member to squeeze medium and separate medium from each other, such that the first medium on the media is separated from other stacked media thereunder;

a paper-feeding member, for receiving the media transferred from the paper-taking member;

a de-skewing member, for de-skewing and transporting the first medium transferred from the paper-feeding member, and preventing other media from entering into the interior of the automatic paper-feeding structure, wherein after the de-skewing member is interacted with the paper-separating member, the medium will be sent out; and a sensor, disposed at another side of the de-skewing member opposite to the media to sense if the medium has already entered the de-skewing member;

wherein the automatic paper-feeding structure further includes a scan member, which receives the paper transferred from the paper-feeding member and proceeds scanning and printing job on the paper;

wherein the de-skewing member is further comprised of a first end and a second end to make the entered document paper generate arced-up face at the first end of the de-skewing member, and the arced-up paper face is abutted to the lower portion of the first end along the curving face of the first end and, when a motor makes a motion of reverse rotation, the second end of the de-skewing member is brought along to press down the document paper, and the first end is lifted upwards to make the document paper carried into the zone of scan member along the paper-feeding member.

2. The automatic paper-feeding structure according to claim 1, wherein the scan member is a scan roller.

3. The automatic paper-feeding structure according to claim 1, wherein the paper-feeding member is further connected to a cam to make the paper-separating member lifted up by the cam, such that other document papers are prevented from entering the paper-feeding member.

4. The automatic paper-feeding structure according to claim 1, wherein the paper-separating member is a paper-separating frictional pad.

5. The automatic paper-feeding structure according to claim 1, wherein the paper-feeding member is a paper-feeding roller.

6. The automatic paper-feeding structure according to claim 1, wherein the paper-taking member is a pickup roller, which uses the friction force between its roller face and the first paper of the document papers to feed the first paper into the interior of the automatic paper-feeding structure.

7. The automatic paper-feeding structure according to claim 1, wherein the sensor is a general electronic sensor, which is used to sense the moving state of the document paper.

8. The automatic paper-feeding structure according to claim 1, wherein the sensor is a mechanical sensor, which is used to sense the moving state of the document paper.

9. The automatic paper-feeding structure according to claim 1, wherein the automatic paper-feeding structure is applied in a printer.

10. The automatic paper-feeding structure according to claim 1, wherein the automatic paper-feeding structure is applied in a photocopy machine.

11. The automatic paper-feeding structure according to claim 1, wherein the automatic paper-feeding structure is applied in a facsimile machine.

12. The automatic paper-feeding structure according to claim 1, wherein the automatic paper-feeding structure is applied in a scanner.

13. The automatic paper-feeding structure according to claim 1, wherein the automatic paper-feeding structure is applied in a multi-functional peripheral (abbreviated as MFP).

* * * * *